US008955233B2

(12) United States Patent
Dean

(10) Patent No.: US 8,955,233 B2
(45) Date of Patent: Feb. 17, 2015

(54) SKATE DRYER AND METHOD FOR USING

(71) Applicant: Liliana A. Dean, Stamford, CT (US)

(72) Inventor: Liliana A. Dean, Stamford, CT (US)

( * ) Notice: Subject to any disclaimer, the term of this patent is extended or adjusted under 35 U.S.C. 154(b) by 217 days.

(21) Appl. No.: 13/761,939

(22) Filed: Feb. 7, 2013

(65) Prior Publication Data

US 2014/0215846 A1 Aug. 7, 2014

(51) Int. Cl.
*F26B 5/16* (2006.01)
*F26B 5/12* (2006.01)
*F26B 9/00* (2006.01)

(52) U.S. Cl.
CPC ... *F26B 5/12* (2013.01); *F26B 5/16* (2013.01); *F26B 9/003* (2013.01)
USPC ..... 34/90; 34/107; 211/205

(58) Field of Classification Search
USPC ..... 34/90, 92, 107, 380, 381, 443; 211/197, 211/205
See application file for complete search history.

(56) References Cited

U.S. PATENT DOCUMENTS

| | | | | | |
|---|---|---|---|---|---|
| D224,309 | S | * | 7/1972 | Wolff | D32/9 |
| 4,021,054 | A | * | 5/1977 | Csutor | 280/825 |
| D272,644 | S | * | 2/1984 | Warren et al. | D32/1 |
| 4,727,656 | A | * | 3/1988 | Jannach et al. | 34/104 |
| 5,009,039 | A | * | 4/1991 | Lager et al. | 451/11 |
| 5,199,188 | A | | 4/1993 | Franz | |
| 5,566,838 | A | * | 10/1996 | Tseng | 211/37 |
| 5,570,515 | A | | 11/1996 | Schulte | |
| 6,134,806 | A | | 10/2000 | Dhaemers | |
| 6,254,110 | B1 | | 7/2001 | Meibock et al. | |
| 6,263,591 | B1 | | 7/2001 | La Porte | |
| 6,591,994 | B1 | * | 7/2003 | Bearss | 211/85.7 |
| 6,880,711 | B2 | | 4/2005 | Collier | |
| 7,176,420 | B2 | | 2/2007 | Abbott et al. | |
| 7,430,816 | B1 | * | 10/2008 | Lozenski | 34/104 |
| D616,537 | S | * | 5/2010 | Gosko-Sadowski | D23/393 |
| D664,321 | S | * | 7/2012 | Williams | D32/58 |
| D682,499 | S | * | 5/2013 | Williams | D32/58 |
| 8,726,534 | B2 | * | 5/2014 | Chappell et al. | 34/202 |
| 2007/0000143 | A1 | * | 1/2007 | Rosseau et al. | 34/104 |
| 2010/0045016 | A1 | * | 2/2010 | Damiano | 280/825 |
| 2014/0215846 | A1 | * | 8/2014 | Dean, Liliana A. | 34/406 |

FOREIGN PATENT DOCUMENTS

| | | | | | |
|---|---|---|---|---|---|
| CA | 2691428 | A1 | * | 7/2011 | |
| CN | 202436788 | U | * | 9/2012 | |
| DE | 4140442 | A1 | * | 6/1993 | A63C 17/04 |
| EP | 465222 | A2 | * | 1/1992 | A43B 5/16 |
| FR | 2777497 | A1 | * | 10/1999 | A63C 19/10 |
| JP | 11128437 | A | * | 5/1999 | A63C 19/10 |
| WO | WO 9605972 | A1 | * | 2/1996 | B60B 5/02 |
| WO | 2008/073008 | | | 6/2008 | |

* cited by examiner

*Primary Examiner* — Steve M Gravini
(74) *Attorney, Agent, or Firm* — Ohlandt, Greeley, Ruggiero & Perle, L.L.P.

(57) ABSTRACT

A skate dryer assembly. The assembly has a skate, a dryer module, and a device for blowing or sucking air through or from the module. The skate includes a boot and a blade. The dryer module defines a slot therein adapted to receiving and retaining the blade therein.

6 Claims, 5 Drawing Sheets

SKATE DRYER AND METHOD FOR USING

BACKGROUND OF THE DISCLOSURE

1. Field of the Disclosure

The disclosure relates to a skate dryer and an assembly thereof with a skate. The disclosure further relates to a method for drying skates.

2. Description of the Related Art

During skating, ice and moisture accumulates on the blades of ice skates. If not effectively removed, the ice and moisture can lead to rust formation on the surfaces of the blades, which is aesthetically undesirable.

A conventional method of removing ice and moisture from the blades of the ice skates is to wipe them off with a dry cloth towel, rag, paper towel, or other absorptive material. A problem with this method is that often a moisture residue remains on the blades after wiping. There is no effective way to determine whether moisture residue remains or whether the entireties of the surfaces of the blades have been completely wiped. Further, with figure skates, the blade designs typically are ornate and contain crevices therein which must be wiped clean. Further, after skating, the edges of the blades are usually quickly covered with protective plastic or rubber edge guards, which tend to entrap any moisture remaining on the edges and blade surfaces proximal to the edges.

It would be desirable to have a device or apparatus in which ice and moisture could be effectively removed from blade surfaces. It would further be desirable to have a method for accomplishing same.

SUMMARY OF THE DISCLOSURE

According to the present disclosure, there is provided a skate dryer assembly. The assembly has a skate, a dryer module, and a device for blowing or sucking air through or from the module. The skate includes a boot and a blade. The dryer module defines a slot therein adapted to receiving and retaining the blade therein. The blade is positioned within the slot and the module.

Further according to the present disclosure, there is provided a skate dryer. The skate dryer has a dryer module defining a slot therein adapted to receiving and retaining a blade of a skate therein and a device for blowing or sucking air through or from the module.

Further according to the present disclosure, there is provided a method for drying a skate, comprising: (a) inserting a blade of the skate into a dryer module defining a slot therein adapted to receiving and retaining the blade, and (b) blowing or sucking air through or from the module.

DETAILED DESCRIPTION OF THE DISCLOSURE

Figure 1:
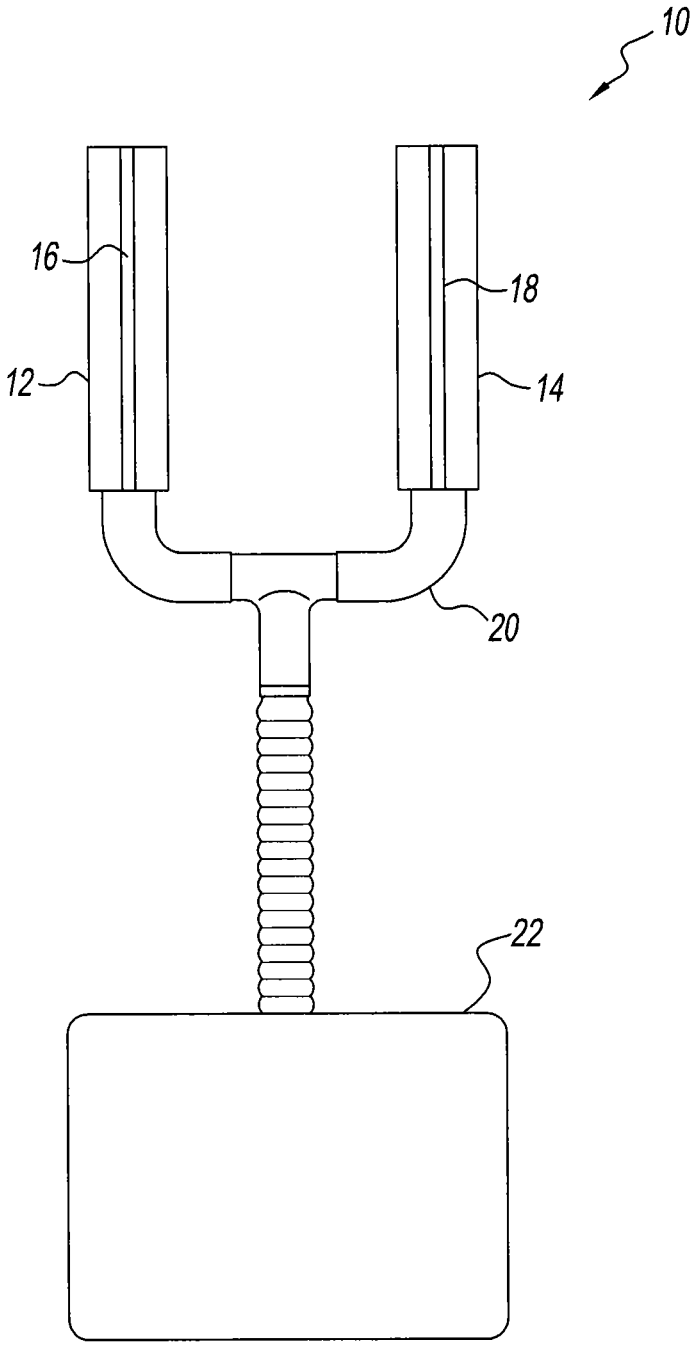
FIG. 1 depicts a plan view of an embodiment of a skate dryer according to the present disclosure.

The dryer modules are receptacles into which blades of ice skates can be inserted. A module can take virtually any shape or configuration longitudinally or in cross-section so long as substantially the entirety or substantially the entirety of a blade can be inserted therein through a slot into a module. By way of example, the modules depicted in the figures herein are substantially tubular.

The slot in the module is typically relatively narrow in width and rectangular in dimension and length and traverses a portion or an entirety of the length of the module. The slot will typically be wide enough to accommodate and engage the blade but not wide enough to accommodate and engage the boot of the skate. The slot is preferably a little wider than the width of the blade such that the blade can be easily and comfortably inserted therein yet remain substantially upright or vertical with respect to the module. In a less preferred embodiment (not depicted herein), the slot can be wide enough to accommodate both the blade and a portion or the entirety of the boot.

Any device known in the art for blowing or sucking air may be employed in the skate dryer of the disclosure. Useful blowers include fans, centrifugal fans, and axial fans. Useful sucking or vacuuming devices include reverse fans and vacuum cleaners. A preferred device for sucking air is an electric vacuum cleaner. In many instances, the device can be positioned in forward or reverse depending on the desired direction of air flow. Air will typically be sucked from or blown through the slots and/or an orifice(s) within the modules at an end portion of the modules opposite that of the source of suction or blowing such that air will contact and traverse substantially the length of the blade prior to entering or exiting the module. When blown air is used, the air optionally may be heated to an elevated temperature (greater than ambient) to facilitate faster drying. The device for blowing or sucking air will typically be electrically operated, either by battery or from a household or commercial electrical grid source, e.g., a wall electrical outlet.

To augment air drying in the dryer, absorptive materials may be incorporated within the modules. Such materials may include a dry towel, rag, or absorptive open-cell foam. Materials can be made of any absorptive material, such as cloth, fabric, or paper. Useful foam materials include plastics and cellulose. Absorptive material may be incorporated within a portion or the entirety of a module.

The dryer is envisioned as useful as a in-home unit, as a portable unit for transport to an ice rink, or as a large-scale permanent unit in an ice rink. A large-scale unit may have a number of slots sufficient to handle multiple pairs of ice skates simultaneously.

It is contemplated that the dryer of the present disclosure will be effective in removing ice and moisture from any type of ice skates, including figure skates and hockey skates. The skates may be removed from the feet and inserted into the slots of the dryer or the skater may step into the slops with the skates on.

An embodiment of the skate dryer is shown in FIG. 1 and is generally referenced by the numeral 10. Skate dryer 10 has dryer modules 12 and 14. Dryer modules 12 and 14 define slots 16 and 18, respectively, therein, that extend longitudinally along the lengths of modules 12 and 14, respectively. Slots 16 and 18 are adapted to or capable of receiving blades of an ice skate (not shown). Modules 12 and 14 are connected to and are in air communication with a vacuum device or blower 22 through a T-shaped conduit 20. Modules 12 and 14 may be open-ended or close-ended at their distal ends thereof opposite that of the connection with conduit 20 but are preferably open-ended. When modules 12 and 14 are close-ended, air is drawn into modules 12 and 14 substantially through slots 16 and 18 only. When modules 12 and 14 are open-ended, air is drawn into modules 12 and 14 through their open ends and through slots 16 and 18.

Figure 2:
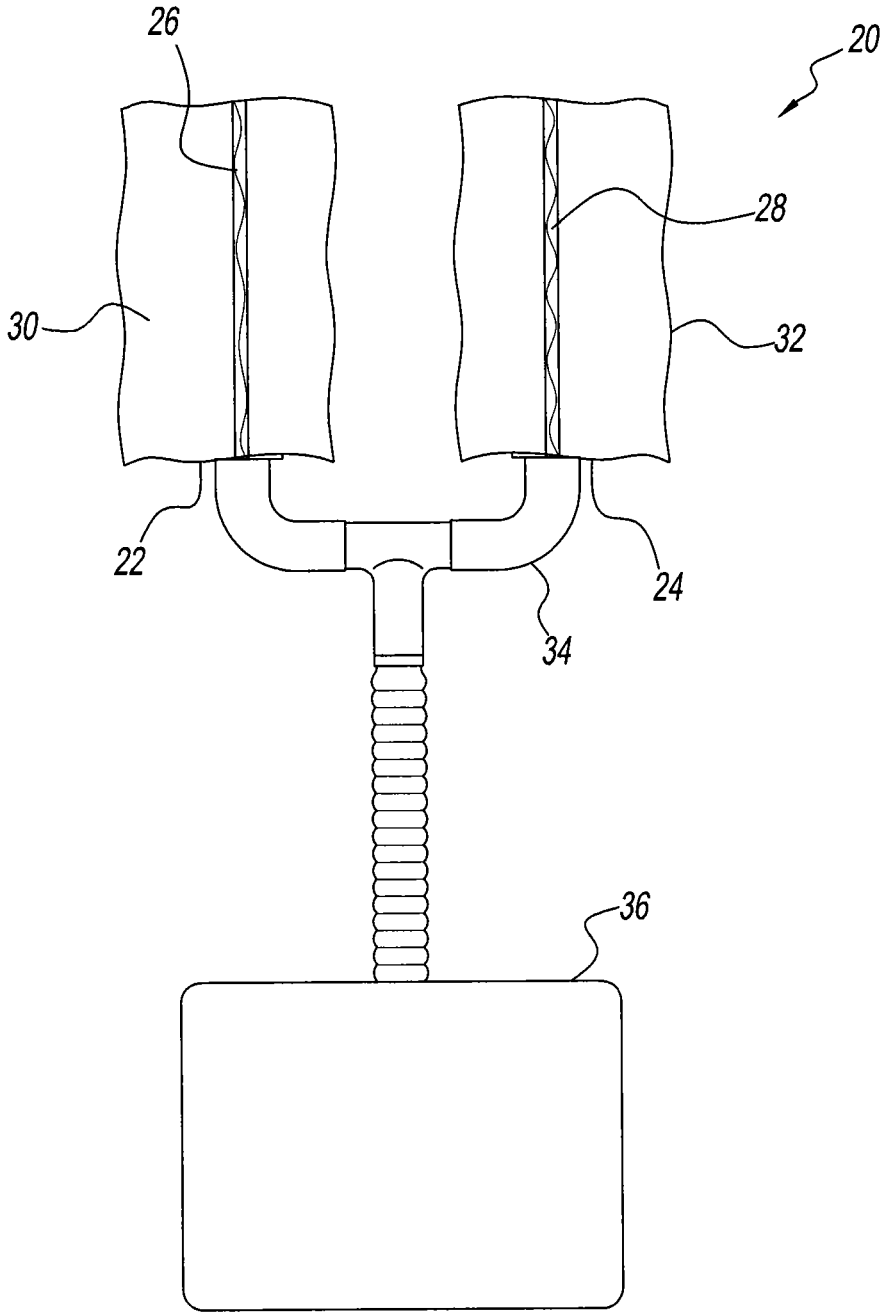
FIG. 2 depicts a plan view of another embodiment of a skate dryer according to the present disclosure.

Another embodiment of the skate dryer is shown in FIG. 2 and is generally referenced by the numeral 20. Skate dryer 20 has dryer modules 22 and 24. Dryer modules 22 and 24 define slots 26 and 28, respectively, therein, that extend longitudinally along the lengths of modules 22 and 24, respectively. Slots 26 and 28 are adapted to or capable of receiving blades of an ice skate (not shown). Portions of towels 30 and 32 are positioned through slots 26 and 28, respectively, into modules 22 and 24, respectively, to provide additional absorptive drying capability to skate dryer 20. Modules 30 and 32 are connected to and are in air communication with a vacuum device or blower 36 through a T-shaped conduit 34.

Figure 3:
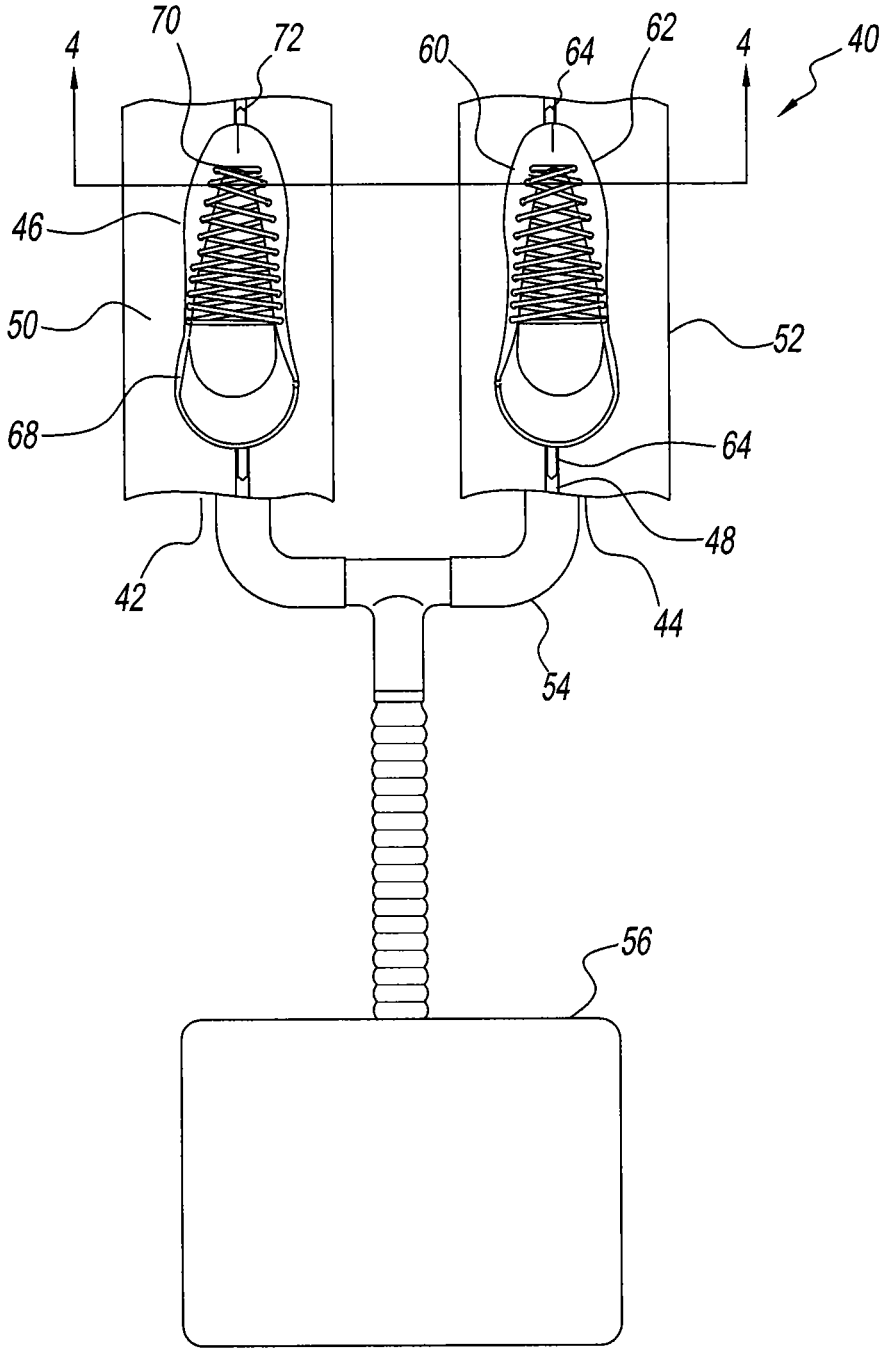
FIG. 3 depicts a plan view of an embodiment of a skate dryer assembly of the present disclosure.
Figure 4:
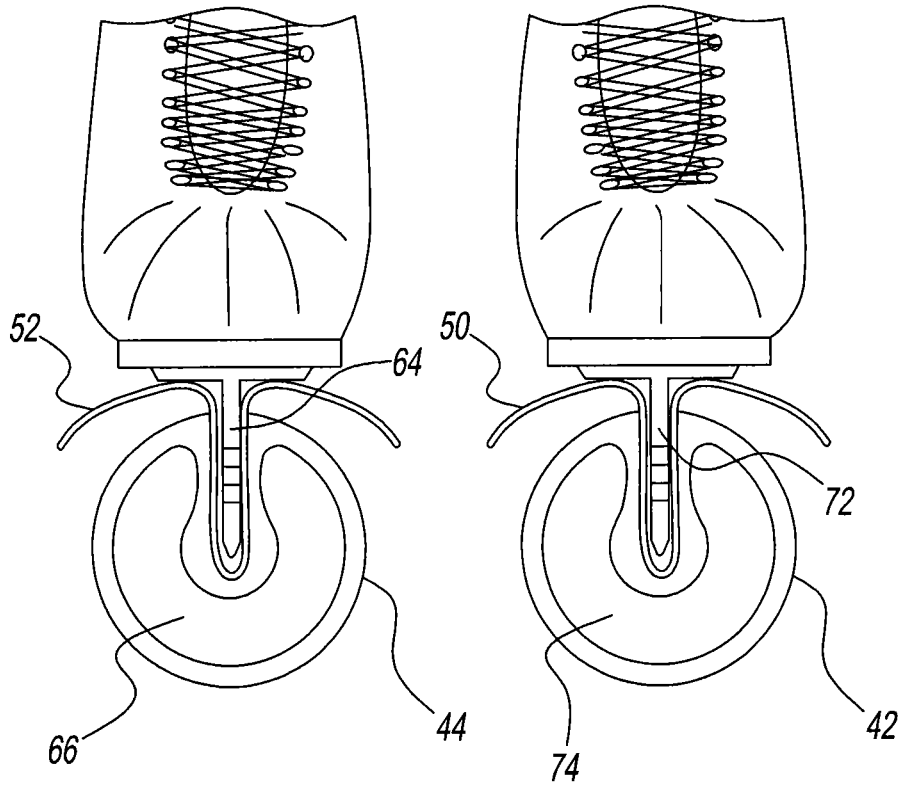
FIG. 4 is an enlarged cross-sectional view of the assembly of FIG. 3 taken along line 4-4.

Another embodiment of the skate dryer is shown in FIG. 3 and is generally referenced by the numeral 40. Skate dryer 40 has dryer modules 42 and 44. Dryer modules 42 and 44 define slots 46 and 48, respectively, therein, that extend longitudinally along the lengths of modules 42 and 44, respectively. Slots 46 and 48 are adapted to or capable of receiving blades 64 and 72, respectively, of a pair of ice skates 60 and 68, respectively. Ice skates 60 and 68 further have boots 62 and 70, respectively. Portions of towels 50 and 52 are positioned through slots 46 and 48, respectively, into modules 42 and 44, respectively, to provide additional absorptive drying capability to skate dryer 40. Modules 50 and 52 are connected to and are in air communication with a vacuum device or blower 56 through a T-shaped conduit 54. Cross-sectional views of modules 42 and 44 along line 4-4 are shown in FIG. 4. As shown in FIG. 4, foam inserts 66 and 74 provide yet additional absorptive drying capability and extend longitudinally through modules 50 and 52.

Figure 6:
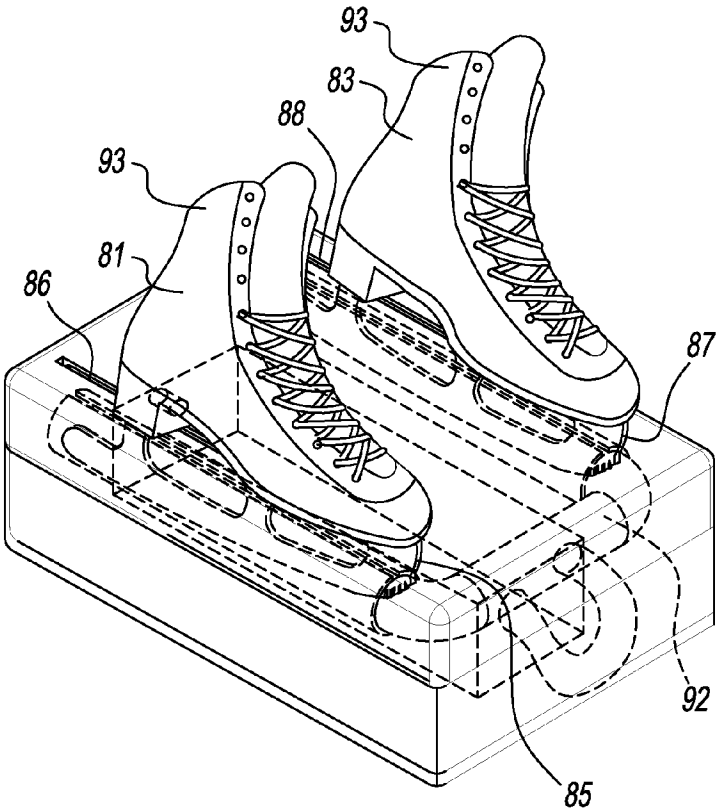
FIG. 6 depicts an oblique view of another embodiment of a skate dryer assembly according to the present disclosure.
Figure 5:
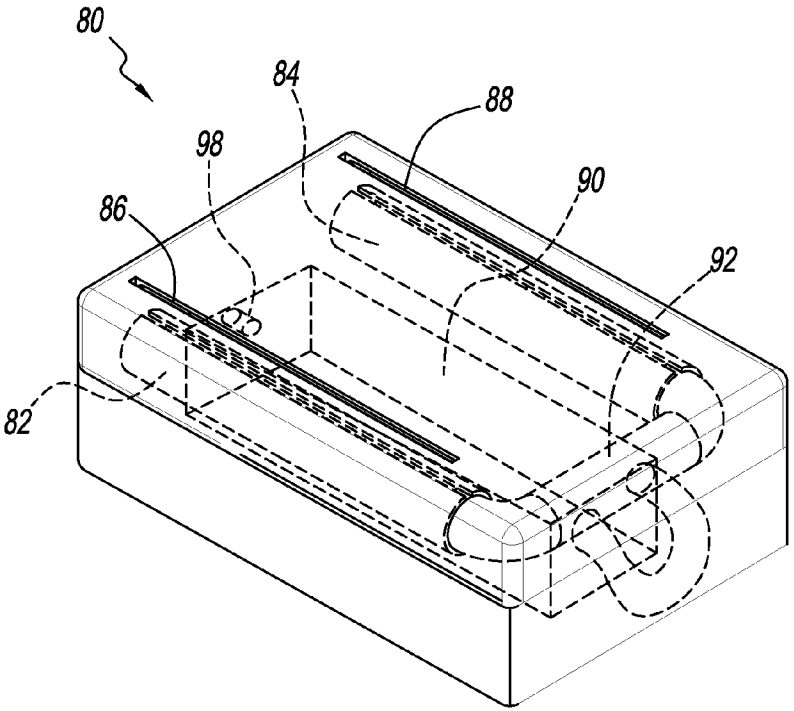
FIG. 5 depicts an oblique view of an embodiment of a skate dryer according to the present disclosure.

An embodiment of the skate dryer is shown in FIGS. 5 and 6 and is generally referenced by the numeral 80. Skate dryer 80 has a right dryer module 82 and a left dryer module 84. Dryer modules 82 and 84 define a left slot 86 and a right slot 88, respectively, therein, that extend longitudinally along the lengths of modules 82 and 84, respectively. A right ice skate 81 has a right boot 93 and a right blade 85. A left ice skate 83 has a left boot 95 a left blade 87. Slots 86 and 88 are adapted to or capable of receiving blades 85 and 87 of ice skates 81 and 83. Modules 82 and 84 are connected to and are in air communication with a vacuum device 90, which is in air communication with modules 82 and 84 through a T-shaped conduit 92. Vacuum device 90 exhaust suctioned air through exhaust conduit 98. Dryer 80 is of unitary and compact structure and has the advantage of portability. If desired, absorbent materials (not shown) optionally can be inserted within modules 82 and 84 in the same manner as the foregoing embodiments.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variances that fall within the scope of the appended claims.

What is claimed is:

1. A skate dryer assembly, comprising: a skate, wherein the skate includes a boot and a blade; a dryer module, wherein the module defines a slot therein adapted to receiving and retaining the blade therein, wherein the blade is positioned within the slot and the module; and a device for blowing or sucking air through or from the module.

2. The assembly of claim 1, wherein the device is a device for blowing air through the module.

3. The assembly of claim 1, wherein the device is a device for sucking air from the module.

4. The assembly of claim 1, wherein the device is a vacuum cleaner.

5. The assembly of claim 1, wherein the assembly further comprises an absorptive material positioned within the module proximal to blade.

6. The assembly of claim 1, wherein there is a left skate and a right skate, wherein the left skate has a left boot and a left blade, wherein the right skate has a right boot and a right blade, wherein there is a left dryer module and a right dryer module, wherein the left dryer module defines a left slot therein adapted to receiving and retaining the left blade therein, wherein the right dryer module defines a left slot therein adapted to receiving and retaining the right blade therein, wherein the left blade is positioned within the left slot and the left dryer module, wherein the right blade is positioned within right slot and the right dryer module, wherein the device for blowing or sucking air is in air communication with the left dryer module and the right dryer module through a T-shaped conduit.

* * * * *